US007218059B2

(12) United States Patent
Li et al.

(10) Patent No.: US 7,218,059 B2
(45) Date of Patent: May 15, 2007

(54) DISCHARGE-LAMP CONTROL DEVICE

(75) Inventors: Ge Li, Tokyo (JP); Koichiro Miura, Tokyo (JP); Takeshi Uematsu, Tokyo (JP)

(73) Assignee: TDK Corporation, Tokyo (JP)

( * ) Notice: Subject to any disclaimer, the term of this patent is extended or adjusted under 35 U.S.C. 154(b) by 22 days.

(21) Appl. No.: 11/254,105

(22) Filed: Oct. 20, 2005

(65) Prior Publication Data

US 2006/0091821 A1 May 4, 2006

(30) Foreign Application Priority Data

Oct. 29, 2004 (JP) ..... 2004-315680

(51) Int. Cl.
*H05B 39/04* (2006.01)

(52) U.S. Cl. ..... 315/209 R; 315/291; 315/224; 315/219; 315/212; 315/307; 315/276; 315/239

(58) Field of Classification Search ..... 315/209 R, 315/241 R, 291, 212, 224–226, 307, 276, 315/239, 219

See application file for complete search history.

(56) References Cited

U.S. PATENT DOCUMENTS 5,500,792 A * 3/1996 Jeon et al. ..... 363/98
5,864,267 A * 1/1999 Hatada et al. ..... 334/61
6,396,719 B2 * 5/2002 Morita et al. ..... 363/21.12
6,630,797 B2 * 10/2003 Qian et al. ..... 315/224
7,110,268 B2 * 9/2006 Yasumura ..... 363/21.03

FOREIGN PATENT DOCUMENTS

JP A 2004-241136 8/2004

* cited by examiner

*Primary Examiner*—Tho Phan
*Assistant Examiner*—Chuc Tran
(74) *Attorney, Agent, or Firm*—Oliff & Berridge, PLC

(57) ABSTRACT

A discharge-lamp control device for lighting a discharge-lamp includes two electrodes, first and second driving units to supply power to the discharge-lamp through the electrodes, respectively. Each driving unit includes a transformer having primary and secondary coils and a capacitor connected in parallel to the secondary coil. The first driving unit has impedance characteristics with a minimum impedance at a first frequency and a maximum impedance at a second frequency lower than the first frequency. The second driving unit has impedance characteristics having a minimum impedance at a third frequency and a maximum impedance at a fourth frequency lower than the third frequency. The first frequency is set to be higher than the third frequency. The second frequency is set to be lower than the fourth frequency. An operating frequency of the driving circuit is selected within a frequency bandwidth from the fourth frequency to the third frequency.

18 Claims, 5 Drawing Sheets

DISCHARGE-LAMP CONTROL DEVICE

BACKGROUND OF THE INVENTION

1. Technical Field

This invention relates to a discharge-lamp control device for controlling a discharge lamp used, for example, as a backlight of a liquid crystal display.

2. Related Art

Liquid crystal displays are widely used as personal computer monitors and/or televisions as well as displays for portable personal computers and word-processors. Recently, as the liquid crystal displays have become larger in size, the number of devices for lighting a plurality of discharge-lamps connected in parallel has increased.

Japanese Patent Application Publication 2004-241136 discloses a discharge-lamp control device for a single discharge-lamp having two electrodes. The discharge-lamp control device includes a pair of inverters, each of which is electrically connected to each of two electrodes. In this apparatus, the lighting of the discharge-lamp is controlled by transmitting high-frequency alternating-current power from the inverter to the discharge-lamp.

However, when this apparatus is used to light a plurality of discharge-lamps connected in parallel, the pair of inverters are necessary for each discharge-lamp, which increases power consumption and manufacturing cost. In order to solve these problems, a new system for lighting the plurality of discharge-lamps has been developed and is commercially available which has two inverter circuits, and two driving circuits connected to each of the inverter circuits. In this system, one inverter is connected to one of the two electrodes of the plurality of discharge-lamps connected in parallel.

However, when the plurality of discharge-lamps connected in parallel is lighted in the above new system, the amount of electric power supplied from the driving circuits to the discharge-lamps may become unbalanced because of variation in the impedances of the discharge-lamps. The power balance may also lose by distributed capacities of the discharge-lamps induced by the alternating-current driving. When the power of the driving circuits is unbalanced, a variation in a current flowing in the discharge-lamp may arise, which may result in shortening the service lives of discharge-lamps.

As described above, variation in the impedances of driving circuits may result in a loss of the power balance and/or current balance of the driving circuits. Therefore, the above phenomenon may lead to variation in the brightness of the discharge-lamp along the longitudinal direction and/or shortening the service lives of the discharge-lamps.

One attempt to conform the impedances of the driving circuits is to mount another component for adjustment, such as a transformer and a ballast capacitor, in the driving circuit. However, it is still difficult to obtain power balance and current balance of the driving circuits because of initial variations in characteristics of these components.

Further, if the transformer and the capacitor are selected with more strict specifications, cost will increase for selecting the components, thereby increasing the manufacturing cost of the discharge-lamp control device.

SUMMARY

An object of the present invention is to provide a discharge-lamp control device which can readily and easily balance the amount of electric power and/or current supplied from driving circuits connected to a discharge-lamp.

The present invention provides a discharge-lamp control device for controlling a discharge-lamp having two electrodes. The discharge-lamp control device includes a first driving unit and a second driving unit. The first driving unit is configured to be connected to one of the two electrodes to supply electric power at an operating frequency to the discharge-lamp. The first driving unit includes a first transformer having a first primary coil and a first secondary coil, and a first capacitor connected in parallel to the first secondary coil. The first driving unit has impedance characteristics with a minimum impedance at a first frequency and a maximum impedance at a second frequency. The second frequency is lower than the first frequency. The second driving unit is configured to be connected to the other of the two electrodes to supply electric power at the operating frequency to the discharge-lamp. The second driving unit includes a second transformer having a second primary coil and a second secondary coil, and a second capacitor connected in parallel to the second secondary coil. The second driving unit has impedance characteristics with a minimum impedance at a third frequency and a maximum impedance at a fourth frequency. The fourth frequency is lower than the third frequency. The first frequency is set to be higher than the third frequency. The second frequency is set to be lower than the fourth frequency. The operating frequency is selected within a frequency bandwidth from the fourth frequency through the third frequency.

The present invention provides a discharge-lamp control device for controlling a plurality of discharge-lamps connected in parallel between a first line and a second line. Each of the plurality of discharge-lamps has two electrodes. Ones of the two electrodes are connected to the first line. The other ones of the two electrodes are connected to the second line. The discharge-lamp control device includes a first driving unit and a second driving unit. The first driving unit is configured to be connected to the first line to supply electric power at an operating frequency to the plurality of the discharge-lamps. The first driving unit includes a first transformer having a first primary coil and a first secondary coil, and a first capacitor connected in parallel to the first secondary coil. The first driving unit has impedance characteristics with a minimum impedance at a first frequency and a maximum impedance at a second frequency. The second frequency is lower than the first frequency. The second driving unit is configured to be connected to the second line to supply electric power at the operating frequency to the plurality of the discharge-lamp. The second driving unit includes a second transformer having a second primary coil and a second secondary coil, and a second capacitor connected in parallel to the second secondary coil. The second driving unit has impedance characteristics with a minimum impedance at a third frequency and a maximum impedance at a fourth frequency. The fourth frequency is lower than the third frequency. The first frequency is set to be higher than the third frequency. The second frequency is set to be lower than the fourth frequency. The operating frequency is selected within a frequency bandwidth from the fourth frequency through the third frequency.

BRIEF DESCRIPTION OF THE DRAWINGS

The particular features and advantages of the invention as well as other objects will become apparent from the following description taken in connection with the accompanying drawings, in which.

DESCRIPTION OF THE EMBODIMENT

Embodiments according to the present invention will be described while referring to FIGS. 1 through 6.

Figure 1:
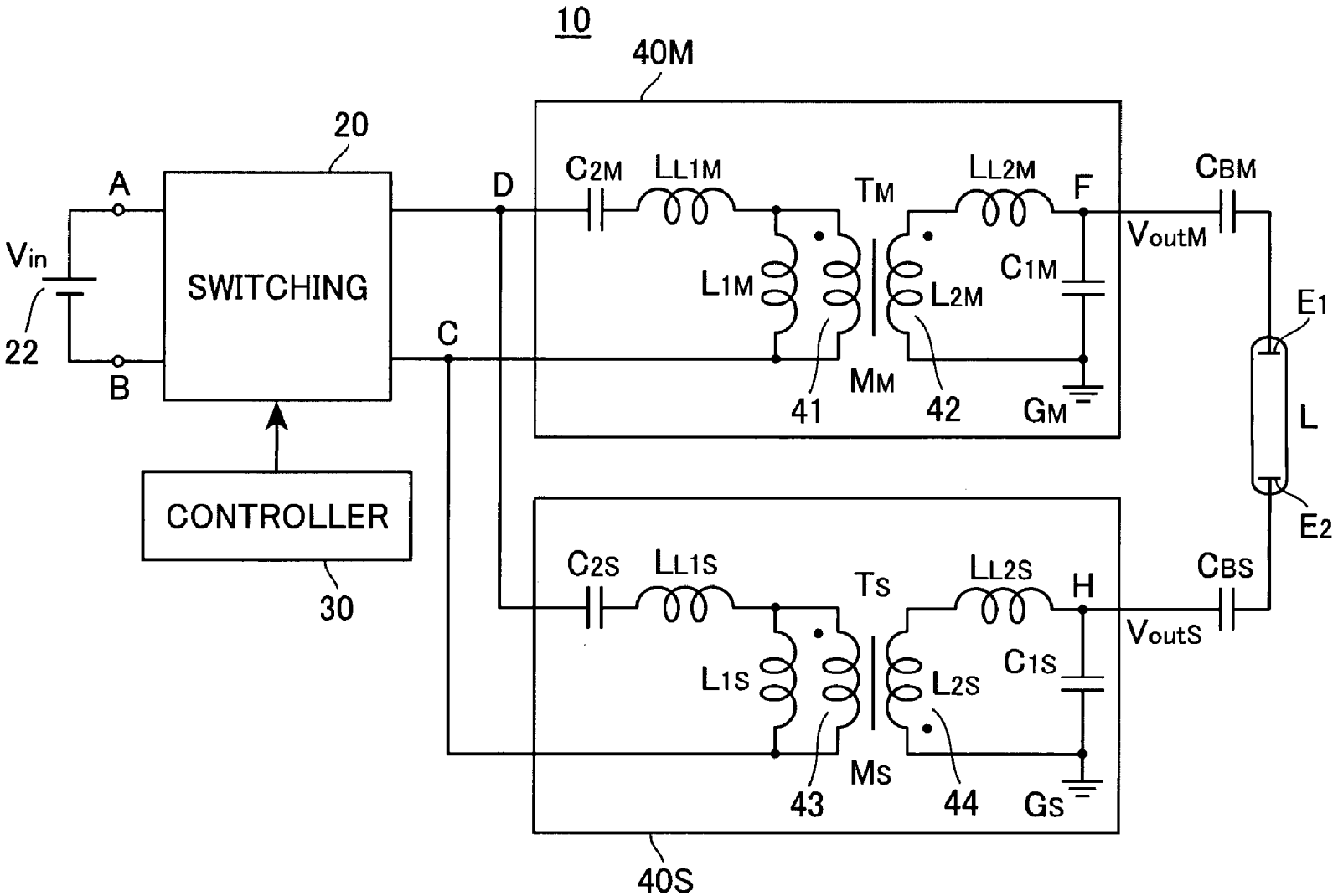
FIG. 1 is a circuit diagram showing a discharge-lamp control device according to an embodiment of the present invention.

FIG. 1 shows a discharge-lamp control device 10 according to an embodiment of the present invention. The discharge-lamp control device 10 controls the lighting of a discharge-lamp L with power supplied from a power source. The discharge-lamp control device 10 includes a switching circuit 20, a control circuit 30, a master driving circuit 40M, and a slave driving circuit 40S. The discharge-lamp L is configured to include a cold-cathode tube having electrodes E1, E2 at both ends thereof. It should be noted that the cold-cathode tube is one example of the discharge-lamp L, and the discharge-lamp control device 10 can control any type of discharge-lamp as well as the cold-cathode tube.

The switching circuit 20 is configured to include an inverter circuit having input terminals A and B and output terminals C and D. The switching circuit 20 is electrically connected to the power supply 22 through the input terminals A and B to receive electric power having a direct-current voltage $V_{in}$ from the power supply 22. The switching circuit 20 is electrically connected to the master driving circuit 40M and the slave driving circuit 40S through the output terminals C and D to supply electric power having a switching frequency to each driving circuit 40M, 40S. The switching circuit 20 is connected to the control circuit 30.

The control circuit 30 produces a control signal to control switching of the switching circuit 20. The control signal determines the switching frequency and the pulse width of the switching. The control circuit 30 performs a suitable electric power control over the switching circuit 20, such as pulse-width modulation (PWM) and phase modulation by means of the control signal.

The master driving circuit 40M has a transformer $T_M$ and a resonant capacitor $C_{1M}$. The transformer $T_M$ has a primary coil 41 and a secondary coil 42 which are wound to have the same polarities to each other. The transformer $T_M$ has a mutual inductance $M_M$, a primary-coil leak inductance $L_{L1M}$, a secondary-coil leak inductance $L_{L2M}$, an exciting impedance $L_{1M}$, and a secondary inductance $L_{2M}$. The primary coil 41 is electrically connected between the terminals C and D. The secondary coil 42 is electrically connected in parallel to the resonant capacitor $C_{1M}$. The resonant capacitor $C_{1M}$ has one end connected to a reference potential $G_M$ and the other end connected to an output terminal F of the master driving circuit 40M. A capacitor $C_{2M}$ is connected between one end of the primary coil 41 and the terminal D. The master driving circuit 40M is electrically connected to the electrode $E_1$ of the discharge-lamp L through the terminal F and a ballast capacitor $C_{BM}$. The ballast capacitor $C_{BM}$ is connected between the master driving circuit 40M and the discharge-lamp L.

The master driving circuit 40M contains a parallel resonant circuit including the resonant capacitor $C_{1M}$ and the exciting inductance $L_{1M}$ which are connected in parallel. The master driving circuit 40M further includes a serial resonant circuit including the resonant capacitor $C_{1M}$ and the secondary inductance $L_{2M}$ which are connected in series. Accordingly, prior to lighting the discharge-lamp L, the master driving circuit 40M has impedance characteristics $Z_M$ having a serial resonant frequency $f_{0sM}$ and a parallel resonant frequency $f_{0pM}$, given by the following equations.

$$f_{0pM} = \frac{1}{2\pi}\sqrt{\frac{L_{1M}}{C_{1M}(L_{1M}\cdot L_{2M} - M_M^2)}} \tag{1}$$

$$f_{0SM} = \frac{1}{2\pi\sqrt{(L_{2M} + L_{L2M})C_{1M}}} \tag{2}$$

where $C_{1M}$ is a capacitance of the resonant capacitor $C_{1M}$, and the serial resonant frequency $f_{0sM}$ is greater than the parallel resonant frequency $f_{0pM}$.

The serial resonant frequency $f_{sM}$ and the parallel resonant frequency $f_{pM}$ of the master driving circuit 40M are changed after lighting the discharge-lamp L as follows;

$$f_{pM} = \frac{1}{2\pi}\sqrt{\frac{L_{1M}}{C_{1M} + Z_{lamp} // C_{BM})(L_{1M}\cdot L_{2M} - M_M^2)}} \tag{3}$$

$$f_{SM} = \frac{1}{2\pi\sqrt{(L_{2M} + L_{L2M})(C_{1M} + Z_{lamp} // C_{BM})}} \tag{4}$$

where $C_{BM}$ is a capacitance of the ballast capacitor $C_{BM}$, $Z_{lamp}$ is an impedance of the discharge-lamp L, and the serial resonant frequency $f_{sM}$ is greater than the parallel resonant frequency $f_{pM}$.

As described above, it is apparent that the serial and parallel resonant frequencies $f_{sM}$ and $f_{pM}$ of the master driving circuit 40M change as a function of the impedance of the discharge-lamp L which is connected to the driving circuits.

The slave driving circuit 40S includes a transformer $T_S$ and a resonant capacitor $C_{1S}$. The transformer $T_S$ includes a primary coil 43 and a secondary coil 44 which are wound to have polarities that are reverse to each other. The transformer $T_S$ has a mutual inductance $M_S$, a primary-coil leak inductance $L_{L1S}$, a secondary-coil leak inductance $L_{L2S}$, an exciting inductance $L_{1S}$, and a secondary inductance $L_{2S}$. The primary coil 43 is electrically connected between the terminals C and D. The secondary coil 44 is connected in parallel to the resonant capacitor $C_{1S}$. The resonant capacitor $C_{1S}$ has one end connected to a reference potential $G_S$ and the other end connected to an output terminal H of the slave driving circuit 40S. A capacitor $C_{2S}$ is connected between one end of the primary coil 41 and the terminal D. The slave driving circuit 40S is electrically connected to the electrode $E_2$ of the discharge-lamp L through the terminal H and a ballast capacitor $C_{BS}$. The ballast capacitor $C_{BS}$ is connected between the slave driving circuit 40S and the discharge-lamp L.

The slave driving circuit 40S includes a parallel resonant circuit having the resonant capacitor $C_{1S}$ and the exciting inductance $L_{1S}$ which are connected in parallel. The slave driving circuit 40S further includes a serial resonant circuit having the resonant capacitor $C_{1S}$ and the secondary inductance $L_{2S}$ which are connected in series.

Therefore, the slave driving circuit 40S has a serial resonant frequency $f_{0sS}$ and a parallel resonant frequency fops defined by equations (5) and (6) prior to lighting the discharge-lamp L, the same as the master driving circuit 40M. The slave driving circuit 40S has a serial resonant frequency $f_{sS}$ and a parallel resonant frequency $f_{pS}$ defined by the equations (7) and (8) after lighting the discharge-lamp L.

$$f_{0pS} = \frac{1}{2\pi}\sqrt{\frac{L_{1S}}{C_{1S}(L_{1S}\cdot L_{2S} - M_S^2)}} \tag{5}$$

$$f_{0sS} = \frac{1}{2\pi\sqrt{(L_{2S} + L_{L2S})C_{1S}}} \tag{6}$$

$$f_{pS} = \frac{1}{2\pi}\sqrt{\frac{1}{(C_{1S} + Z_{lamp} // C_{BS})(L_{1S}\cdot L_{2S} - M_M^2)}} \tag{7}$$

$$f_{sS} = \frac{1}{2\pi\sqrt{(L_{2S} + L_{L2S})(C_{1S} + Z_{lamp} // C_{BS})}} \tag{8}$$

In the slave driving circuit 40S, the serial resonant frequency $f_{0sS}$ is greater than the parallel resonant frequency $f_{0pS}$, as in the case of the master driving circuit 40M. Even after lighting the discharge-lamp L, the serial resonant frequency $f_{sS}$ remains greater than the parallel resonant frequency $f_{pS}$. The serial and parallel resonant frequencies $f_{sS}$ and $f_{ps}$ of the slave driving circuit 40S change as a function of the impedance of the discharge-lamp L, as the master driving circuit 40M.

The next description will be made for explaining characteristics of the master and slave driving circuits 40M and 40S.

The transformers $T_S$ and $T_M$ have the same structure and the same transformer voltage ratio except for the polarities of the primary and secondary coils. In this embodiment, the transformers $T_S$ and $T_M$ manufactured to have the same characteristics except for the polarities are adopted for the driving circuits 40M and 40S. The capacitors $C_{1M}$ and $C_{1S}$ have the same capacitance. In other words, The capacitors $C_{1M}$ and $C_{1S}$ manufactured to have the same characteristics including a capacitance are adopted for the driving circuits 40M and 40S. Accordingly, the slave driving circuit 40S is basically expected to have the same impedance characteristics as the master driving circuit 40M.

However, generally, impedance characteristics $Z_M$ of the master driving circuit 40M are often inconsistent with impedance characteristics $Z_S$ of the slave driving circuit 40S, due to manufacturing tolerances of the transformers $T_M$, $T_S$ and capacitors $C_{1M}$ $C_{1S}$, even if the corresponding components of the driving circuits 40M and 40S are manufactured to have the same characteristics.

Figure 2:
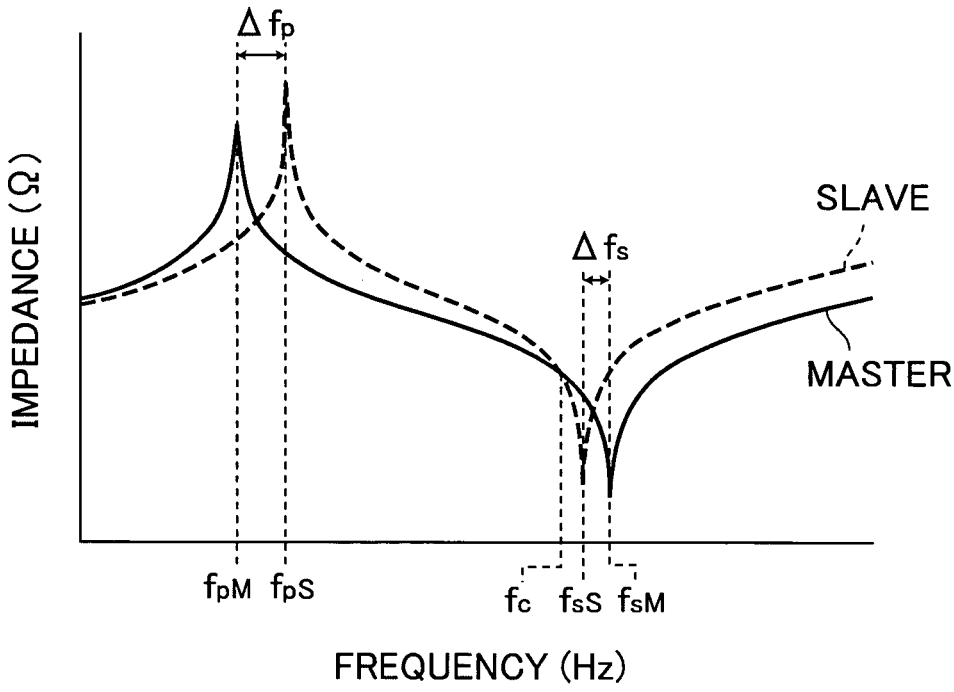
FIG. 2 is a graph showing impedance characteristics of a master driving circuit and a slave driving circuit in the discharge-lamp control device.

Referring to FIG. 2, the master driving circuit 40M and the slave driving circuit 40S have a relationship in terms of the impedance characteristics $Z_M$ and $Z_S$ as follows:

$$f_{pM} < f_{pS},\ 10\text{ kHz} < \Delta f_p < 40\text{ kHz} \tag{9}$$

$$f_{sS} < f_{sM},\ 10\text{ kHz} < \Delta f_s < 20\text{ kHz} \tag{10}$$

where $\Delta f_p = f_{pS} - f_{pM}$, $\Delta f_s = f_{sM} - f_{sS}$

FIG. 2 shows one example of the impedance characteristics of the master driving circuit 40M and slave driving circuit 40S which satisfy equations (9) and (10). If the impedance characteristics $Z_M$ an $Z_S$ have a relationship satisfying equations (9) and (10), the impedance characteristics $Z_M$ an $Z_S$ have an intersection point at a frequency $f_c$ within the bandwidth from the parallel resonant frequency $f_{pS}$ to the serial resonant frequency $f_{sS}$. In other words, the impedance value $Z_M$ of the master driving circuit 40M is equal to the impedance value $Z_S$ of the slave driving circuit 40S at the frequency $f_c$.

The next description will be made for explaining the operation of the discharge-lamp control device 10. When the switching circuit 20 receives a control signal from the control circuit 30, the switching circuit 20 converts input power of the power supply 22 to high frequency alternating-current power having a switching frequency f defined by the control signal. The switching circuit 20 then supplies the high frequency alternating-current power to both of the master driving circuit 40M and the slave driving circuit 40S.

The master driving circuit 40M operates at an operating frequency corresponding to the switching frequency f. The master driving circuit 40M converts an input voltage from the switching circuit 20 to an output voltage $V_{outM}$ to apply the converted voltage $_{outM}$ to the electrode $E_1$ of the discharge-lamp L.

The slave driving circuit 40S also operates at the same operating frequency as that of the master driving circuit 40M. The slave driving circuit 40S converts the input voltage from the switching circuit 20 into an output voltage $V_{outS}$ to apply the output voltage $V_{outS}$ to the electrode $E_2$ of the discharge-lamp L. A 180-degree phase shift is generated between the output voltages $V_{outS}$ and $V_{outM}$, because the transformer $T_M$ of the master driving circuit 40M has a polarity that is reverse to that of the transformer $T_S$ of the slave driving circuit 40S. Therefore, a voltage of $|V_{outM} + V_{outS}|$ is applied between the electrodes $E_1$ and $E_2$ of the discharge-lamp L to control the lighting of the discharge-lamp L.

When driving the master driving circuit 40M and the slave driving circuit 40S at the operating frequency corresponding to the intersecting point shown in FIG. 2, the impedance of the master driving circuit 40M becomes equal to that of the slave driving circuit 40S. The electric power supplied from the master driving circuit 40M becomes equal to the electric power supplied from the slave driving circuit 40S, because the applied voltage from the switching circuit 20 to the master driving circuit 40M is equal to the applied voltage from the switching circuit 20 to the slave driving circuit 40S. Accordingly, the amount of current flow to the discharge-lamp L through the electrode $E_1$ is equal to the amount of current flow to the discharge-lamp L through the electrode $E_2$, because the amount of electric power of the master driving circuit 40M is balanced with the amount of electric power of the slave driving circuit 40S. Therefore, a detrimental effect on the operating life of the discharge-lamp L can be avoided. For example, shortening of the operating life of the discharge-lamp is avoided.

The operating frequency of the driving circuits 40M and 40S is determined in order that the driving circuits 40M and 40S may have the same impedances, after the driving circuits 40M and 40S are assembled into the discharge-lamp control device 10. Accordingly, criteria to select an electric component constituting the driving circuits 40M and 40S can be relaxed. Therefore, there is no need to strictly select each and every electric component constituting the driving circuits 40M and 40S in order to impose the same impedance on the driving circuits 40M and 40S in manufacturing the discharge-lamp control device 10. Accordingly, the manufacturing cost of the discharge-lamp control device 10 can be reduced.

Further, the operating frequency of the driving circuits 40M and 40S is determined in order that the driving circuits 40M and 40S may have the same impedances, after a discharge-lamp L is connected to the discharge-lamp control device 10. Accordingly, the amount of electric power from the master driving circuit 40M can be balanced with the amount of electric power from the slave driving circuit 40S, even if the impedance of the discharge-lamp L changes.

When the impedance characteristics $Z_M$ and $Z_S$ have the following relationship defined by equations (11) and (12), the discharge-lamp control device 10 has similar advantages of those of the driving circuits 40M and 40S satisfying equations (9) and (10).

$$f_{pM}<f_{pS},\ 10\ \text{kHz}<\Delta f_p'<20\ \text{kHz} \quad (11)$$

$$f_{sM}<f_{sS},\ 10\ \text{kHz}<\Delta f_s'<20\ \text{kHz} \quad (12)$$

wherein $\Delta f_p'=f_{pS}-f_{pM}$, $\Delta f_s'=f_{sS}-f_{sM}$.

Figure 3:
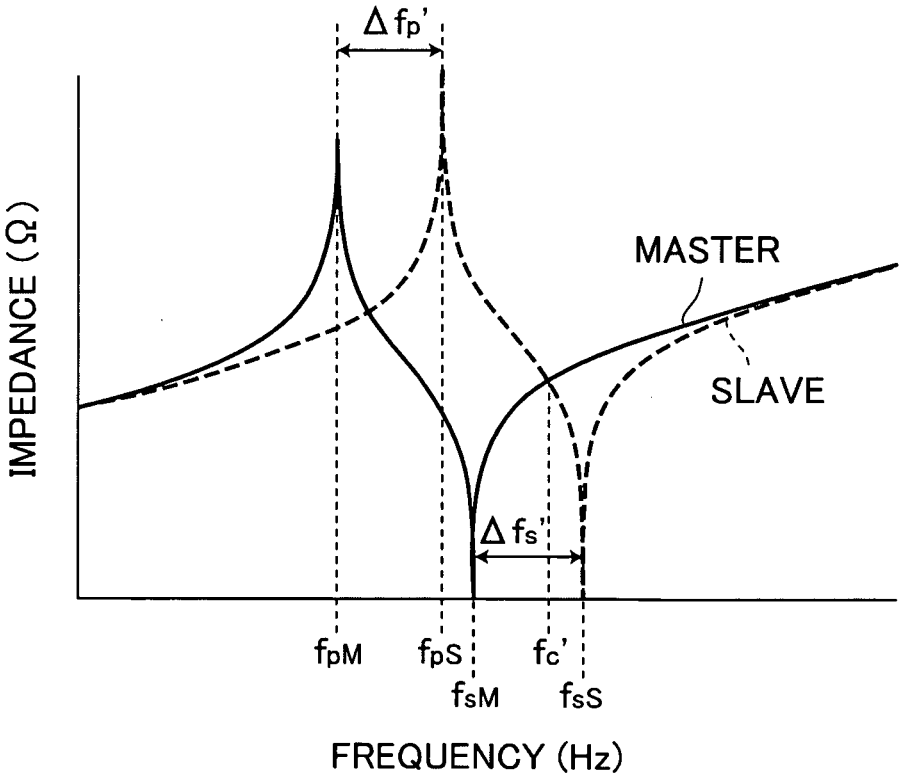
FIG. 3 is a graph showing another impedance characteristics of the master driving circuit and the slave driving circuit in the discharge-lamp control device.

FIG. 3 shows another example of the impedance characteristics of the driving circuits 40M and 40S satisfying equations (11) and (12). If the impedance characteristics $Z_M$ and $Z_S$ satisfy equations (11) and (12), the impedance characteristics $Z_M$ and $Z_S$ have an intersecting point at a frequency fc' within the bandwidth from the serial resonant frequency $f_{sM}$ to the serial resonant frequency $f_{sS}$. In other words, the impedance of the master driving circuit 40M is equal to the impedance of the slave driving circuit 40S at the frequency fc'.

Accordingly, if the switching circuit 20 is switching at the frequency $f_c'$, and the master and slave driving circuits 40M and 40S are driven at the frequency $f_c'$, the impedance of the master driving circuit 40M becomes equal to the impedance of the slave driving circuit 40S. Simultaneously, the amount of electric power of the driving circuit 40M can be balanced with the amount of electric power of the driving circuit 40S, because the same voltages are applied to both of the driving circuits 40M and 40S.

Figure 4:
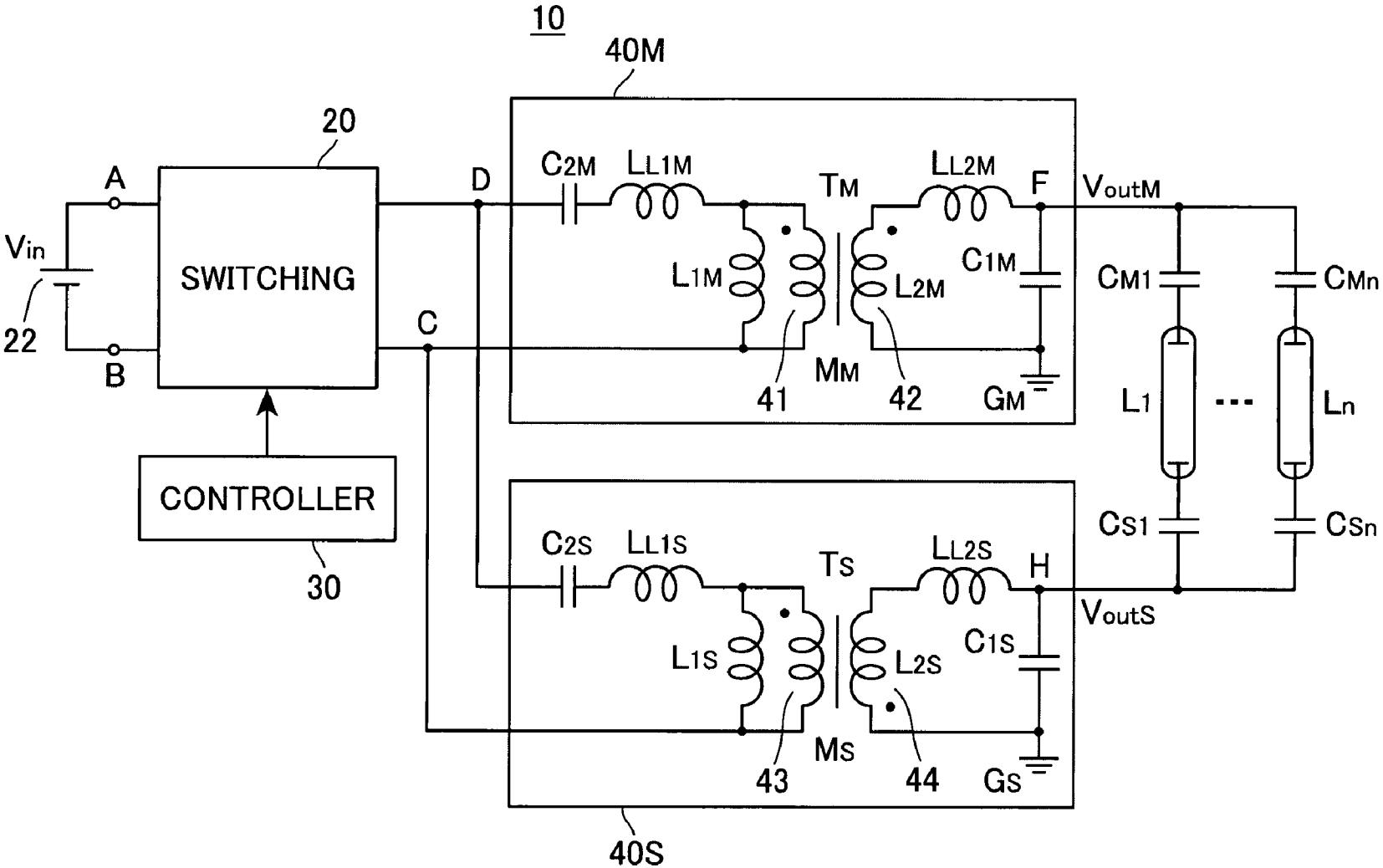
FIG. 4 is a circuit diagram showing a discharge-lamp control device for lighting a plurality of discharge-lamps connected in parallel.

In this embodiment, the discharge-lamp control device 10 controls lighting of a single discharge-lamp L. Alternatively, the discharge-lamp control device 10 is capable of lighting a plurality of discharge-lamps L connected in parallel, as shown in FIG. 4. Referring to FIG. 4, n-number discharge-lamps $L_1$–$L_n$ are connected in parallel. Each discharge-lamp $L_i$ has one electrode connected to the output terminal F of the master driving circuit 40M through a capacitor $C_{Mi}$ and the other electrode connected to the output terminal H of the slave driving circuit 40S through a capacitor $C_{si}$. It should be note that "n" is an integer equal to or greater than 2 and "i" is an integer between 1 through "n".

Figure 5:
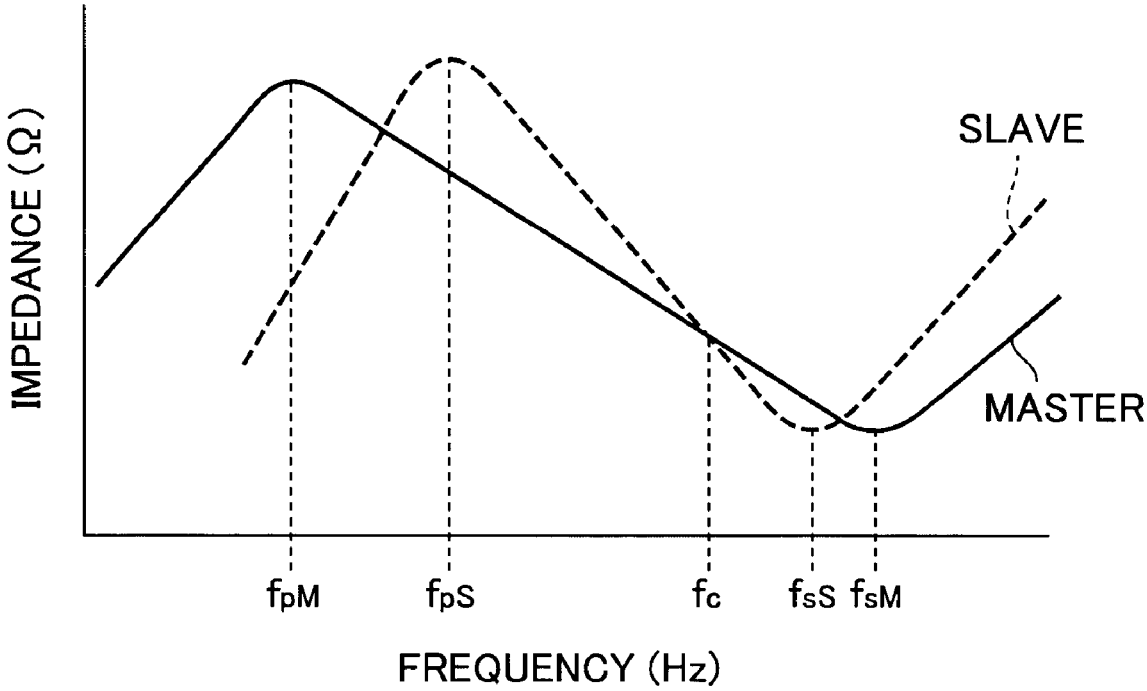
FIG. 5 is a graph showing impedance characteristics of the master driving circuit and the slave driving circuit for lighting the plurality of discharge-lamps connected in parallel.

When the plurality of discharge-lamps L is connected in parallel to be lighted, the impedance characteristics $Z_M$ and $Z_S$ of the master and slave driving circuits 40M and 40S do not have abrupt peak impedance values as the serial resonant frequency and the parallel resonant frequency. As shown in FIG. 5, the parallel resonant frequencies $f_{pM}$ and $f_{pS}$ appear as sloping maximum impedance values within the lower-frequency bandwidth. The serial maximum resonant frequencies $f_{sM}$ and $f_{sS}$ appear as minimum impedance values within the higher-frequency bandwidth which is higher than the lower-frequency bandwidth. After lighting the plurality of discharge-lamps L, the impedance characteristics of the driving circuit for controlling the plurality of discharge-lamps L is combined impedance characteristics of the driving circuit for a single discharge-lamp L, because each discharge-lamp L has a different impedance from each other.

In this case, the minimum and maximum values of each driving circuit 40M, 40S are regarded as the serial and parallel resonant frequencies, respectively, and then the driving circuits are configured in order that the impedance characteristics $Z_M$ and $Z_S$ may meet one of the conditions which satisfies equations (9) and (10) and the condition which satisfies equations (11) and (12), it is preferable that the impedance characteristics $Z_M$ and $Z_S$ satisfy equations (9) and (10). Therefore, the frequency fc at which the impedances $Z_M$ and $Z_S$ are equal to each other can be set as the operating frequency of the discharge-lamp control device 10. Accordingly, when the driving circuits 40M and 40S light the plurality of discharge-lamps L connected in parallel, the amount of electric power of the master driving circuit 40M is balanced with the amount of electric power of the slave driving circuit 40S.

In this embodiment, a description is given for the driving circuits $\mathbf{40}_M$ and $\mathbf{40}_S$ having the impedance characteristics $Z_M$, $Z_S$ which intersect at the frequency $f_c$ within a predetermined frequency bandwidth from $f_{pS}$ to $f_{sS}$. Unless the impedance characteristics $Z_M$ and $Z_S$ have an intersecting point frequency $f_c$ within the predetermined frequency bandwidth, a frequency f at which the impedance $Z_M$ is in proximity to the impedance $Z_S$ is adopted as the switching frequency of the switching circuit 20. In other words, the frequency at which the impedance $Z_M$ is considered to be substantially the same as the impedance $Z_S$ can be set as the switching frequency of the switching circuit 20.

In this case, the electric power of the driving circuit 40M is determined to be approximately balanced with the electric power of the driving circuit 40S. As a result, the service lives of the discharge-lamps L are not shortened by the power imbalance of the driving circuits, and the discharge-lamp L can emit light uniformly along its longitudinal direction.

One way to search for the frequency at which the impedance $Z_M$ is equal to the impedance $Z_S$ is a simulation of the impedance characteristics $Z_M$ and $Z_S$ of the driving circuits 40M and 40S. With the simulation, an intersecting point of the two characteristics curves can be obtained and thus the intersecting frequency point can be set as the operating frequency $f_c$.

Figure 6:
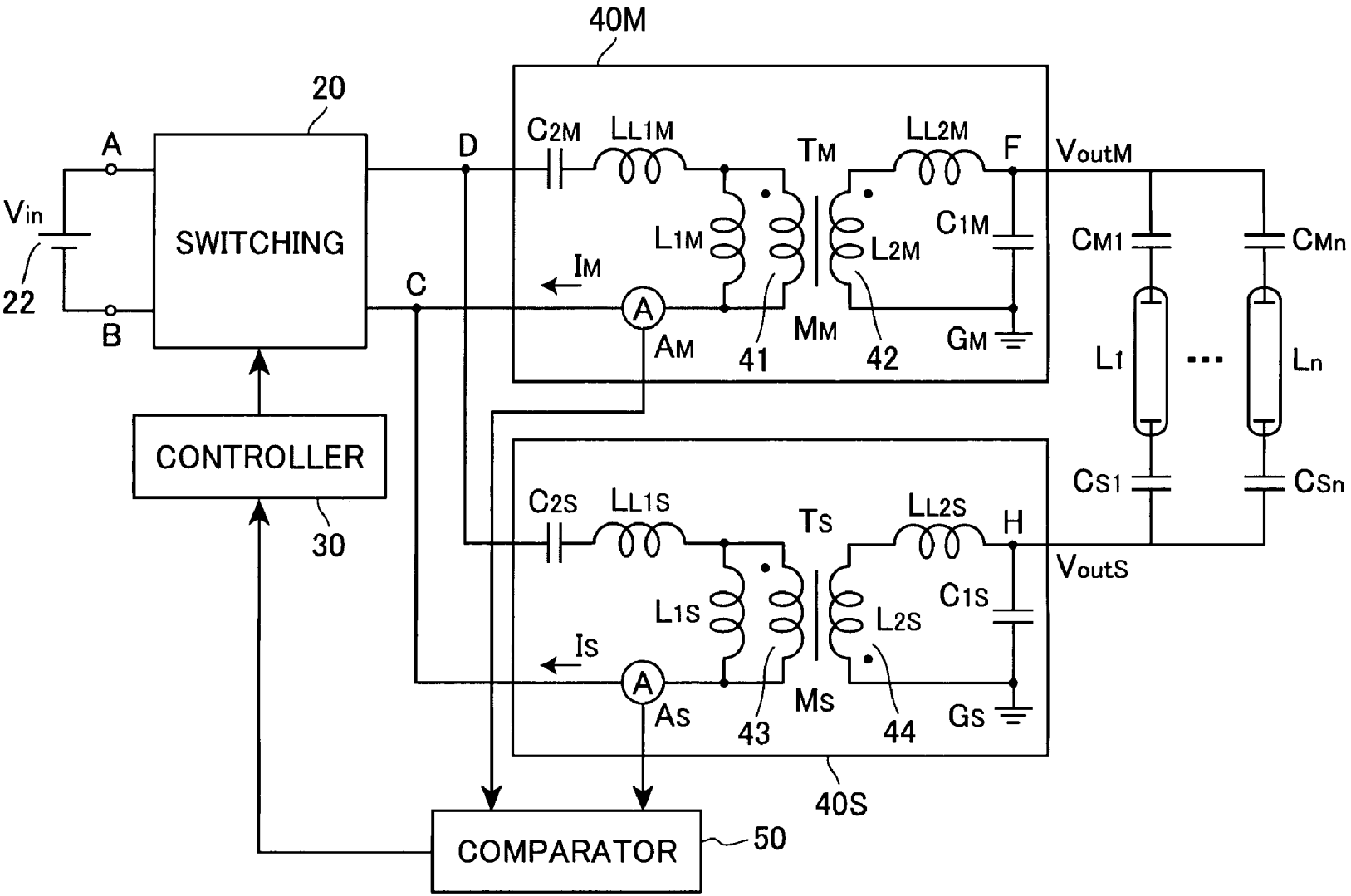
FIG. 6 is a circuit diagram searching for an alternating-current frequency at which an impedance of the master driving circuit matches an impedance of the slave driving circuit.

Another way is an experiment to search for the frequency of the intersecting point of the impedance characteristics $Z_M$ and $Z_S$. Referring to FIG. 6, an alternating-current frequency at which the impedance $Z_M$ matches the impedance $Z_S$ can be searched for by a measurement. An ammeter $A_M$ for measuring an amount of current $I_M$ flowing through the primary coil 41 of the transformer $T_M$ is provided in the master driving circuit 40M. Another ammeter $A_S$ for measuring an amount of current $I_S$ flowing through the primary coil 43 of the transformer $T_S$ is provided in the slave driving circuit 40S. A comparator 50 receives detection signals from the ammeters $A_M$ and $A_S$ and compares one detection signal with the other signal. The control circuit 30 selects the switching frequency of the switching circuit 20 to meet the relationship of $\Delta I=I_M-I_S=0$.

Even when the discharge-lamp control device 10 is used to light a single discharge-lamp L, a frequency fc at which the impedance $Z_M$ is equal to the impedance $Z_S$ can be searched for.

In this case, a phase matching of the detected currents $I_M$ and $I_S$ is one of the requirements for searching for the intersecting frequency fc. It is preferable that the phase of the current $I_M$ matches the phase of the current $I_S$ at a given frequency. However, if the phases of the currents $I_M$ and $I_S$ do not match but root-mean-square currents or effective currents of the currents $I_M$ and $I_S$ match at the given frequency, the impedances $Z_M$ and $Z_S$ are considered close to each other at the given frequency. The electric power of the driving circuit 40M can be approximately balanced with the electric power of the driving circuit 40S at the given frequency. Accordingly, the frequency to satisfy the condition: $\Delta I=I_M-I_S=0$ can be determined by measuring the effective current value and/or effective power. The determined frequency can be set as the operating frequency of the driving circuits 40M and 40S.

As described above, after the master and slave driving circuits are assembled from electric components which have the same structure and characteristics, the frequency at which the impedance $Z_M$ matches the impedance $Z_S$ is determined by simulation or experimentation and set as the operating frequency for the both driving circuits. Accordingly, the electric power of the master driving circuit 40M is balanced with the electric power of the slave driving circuit 40S. Further, the current of the driving circuit 40M is balanced with the current of the driving circuit 40S. Therefore, the strict sorting of electric components for the discharge-lamp control device is not necessary when assembling the discharge-lamp control device. Accordingly, the manufacturing cost of the discharge-lamp control device can be reduced.

In the above embodiment, the transformers $T_M$, $T_S$ having the same transformer voltage ratio are used, and the capacitors $C_{1M}$, $C_{1S}$ having the same capacitors are used. However, if the driving circuits 40M, 40S obtain the same impedance at a given frequency, any electric components other than the above components $T_M$, $T_S$; $C_{1M}$, $C_{1S}$ can be used for the driving circuits 40M, 40S.

Referring to the drawings, like elements in the drawings are identified by the same reference numerals. It is understood that the foregoing description and accompanying drawings set forth the embodiments of the invention. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A discharge-lamp control device for controlling a discharge-lamp having two electrodes, comprising:

a first driving unit configured to be connected to one of the two electrodes to supply electric power at an operating frequency to the discharge-lamp, the first driving unit comprising a first transformer having a first primary coil and a first secondary coil, and a first capacitor connected in parallel to the first secondary coil, the first driving unit having first impedance characteristics with a minimum impedance at a first frequency and a maximum impedance at a second frequency, the second frequency being lower than the first frequency; and a second driving unit configured to be connected to the other of the two electrodes to supply electric power at the operating frequency to the discharge-lamp, the second driving unit comprising a second transformer having a second primary coil and a second secondary coil, and a second capacitor connected in parallel to the second secondary coil, the second driving unit having second impedance characteristics with a minimum impedance at a third frequency and a maximum impedance at a fourth frequency, the fourth frequency being lower than the third frequency, wherein the first frequency is set to be higher than the third frequency, the second frequency is set to be lower than the fourth frequency, and the operating frequency is selected to fall within a frequency bandwidth from the fourth frequency through the third frequency.

2. The discharge-lamp control device according to claim 1, wherein the first impedance characteristics cross the second impedance characteristics at an intersecting-point frequency within the frequency bandwidth, and the intersecting-point frequency is set as the operating frequency.

3. The discharge-lamp control device according to claim 1, wherein the first frequency is a serial resonant frequency of the first driving circuit, the second frequency is a parallel resonant frequency of the first driving circuit, the third frequency is a serial resonant frequency of the second driving circuit, the fourth frequency is a parallel resonant frequency of the second driving circuit.

4. The discharge-lamp control device according to claim 1, further comprising a controller that determines the operating frequency at which an impedance of the first impedance characteristics is equal to an impedance of the second impedance characteristics.

5. The discharge-lamp control device according to claim 4, further comprising an ammeter that measures a current flow in each of the first and second driving circuits, wherein the controller receives the current flow measured by the ammeter to determine the operating frequency.

6. The discharge-lamp control device according to claim 5, wherein the controller determines the operating frequency in order that a root-mean-square value of the current of the first driving circuit is consistent with an effective value of the current flow of the second driving circuit.

7. The discharge-lamp control device according to claim 6, wherein the controller determines the operating frequency in order that a phase of the current flow of the first driving circuit is consistent with a phase of the current flow of the second driving circuit.

8. The discharge-lamp control device according to claim 1, further comprising a controller that determines the operating frequency at which an impedance of the first impedance characteristics is substantially similar to an impedance of the second impedance characteristics.

9. The discharge-lamp control device according to claim 1, wherein the first and second transformers have the same structure and the same transformer voltage ratio, and the first and second capacitors have the same capacitances.

10. A discharge-lamp control device for controlling a plurality of discharge-lamps connected in parallel between a first line and a second line, each of the plurality of discharge-lamp having two electrodes, ones of the two electrodes being connected to the first line, and the other ones of the two electrodes being connected to the second line, comprising:

a first driving unit configured to be connected to the first line to supply electric power at an operating frequency to the plurality of discharge-lamps, the first driving unit comprising a first transformer having a first primary coil and a first secondary coil, and a first capacitor connected in parallel to the first secondary coil, the first driving unit having first impedance characteristics with a minimum impedance at a first frequency and a maximum impedance at a second frequency, the second frequency being lower than the first frequency; and a second driving unit configured to be connected to the second line to supply electric power at the operating frequency to the plurality of discharge-lamps, the second driving unit comprising a second transformer having a second primary coil and a second secondary coil, and a second capacitor connected in parallel to the second secondary coil, the second driving unit having second impedance characteristics with a minimum impedance at a third frequency and a maximum impedance at a fourth frequency, the fourth frequency being lower than the third frequency, wherein the first frequency is set to be higher than the third frequency, the second frequency is set to be lower than the fourth frequency, and the operating frequency is selected to fall within a frequency bandwidth from the fourth frequency through the third frequency.

11. The discharge-lamp control device according to claim 10, wherein the first impedance characteristics cross the second impedance characteristics at an intersecting-point frequency within the frequency bandwidth, and the intersecting-point frequency is set as the operating frequency.

12. The discharge-lamp control device according to claim 10, wherein the first frequency is a serial resonant frequency of the first driving circuit, the second frequency is a parallel resonant frequency of the first driving circuit, the third frequency is a serial resonant frequency of the second driving circuit, the fourth frequency is a parallel resonant frequency of the second driving circuit.

13. The discharge-lamp control device according to claim 10, further comprising a controller that determines the operating frequency at which an impedance of the first impedance characteristics is equal to an impedance of the second impedance characteristics.

14. The discharge-lamp control device according to claim 13, further comprising an ammeter that measures a current flow in each of the first and second driving circuits, wherein the controller receives the current flow measured by the ammeter to determine the operating frequency.

15. The discharge-lamp control device according to claim 14, wherein the controller determines the operating frequency in order that a root-mean-square value of the current flow of the first driving circuit is consistent with an effective value of the current flow of the second driving circuit.

16. The discharge-lamp control device according to claim 15, wherein the controller determines the operating frequency so that a phase of the current flow of the first driving circuit is consistent with a phase of the current flow of the second driving circuit.

17. The discharge-lamp control device according to claim 10, further comprising a controller that determines the operating frequency at which an impedance of the first impedance characteristics is substantially similar to an impedance of the second impedance characteristics.

18. The discharge-lamp control device according to claim 10, wherein the first and second transformers have the same structure and the same transformer voltage ratio, and the first and second capacitors have the same capacitances.

* * * * *